US005745917A

United States Patent [19]

Dicker et al.

[11] Patent Number: 5,745,917

[45] Date of Patent: May 5, 1998

[54] ENERGY EXPENDITURE GARMENT

[76] Inventors: Timothy P. Dicker, 6906 Foothill Blvd., Tujunga, Calif. 91042; William T. Wilkinson, P. O. Box 73, Salem, N.J. 08079

[21] Appl. No.: 777,455

[22] Filed: Dec. 30, 1996

[51] Int. Cl.[6] ..... A41D 13/00

[52] U.S. Cl. ..... 2/69; 2/228; 2/115; 482/105

[58] Field of Search ..... 2/69, 79, 227, 2/228, 238, 170, 108, 115, 102; 482/105, 121, 124, 131, 74; 450/104

[56] References Cited

U.S. PATENT DOCUMENTS

| | | | |
|---|---|---|---|
| 1,178,165 | 8/1916 | Lupton . | |
| 2,097,376 | 7/1937 | Marshman . | |
| 2,613,932 | 10/1952 | Manners . | |
| 3,411,500 | 11/1968 | Gatts . | |
| 3,559,654 | 2/1971 | Pope . | |
| 3,759,510 | 9/1973 | Jackson . | |
| 4,065,814 | 1/1978 | Fox . | |
| 4,220,299 | 9/1980 | Motter . | |
| 4,325,379 | 4/1982 | Ozbey | 450/104 |
| 4,384,369 | 5/1983 | Prince . | |
| 4,670,913 | 6/1987 | Morell . | |
| 4,698,847 | 10/1987 | Yoshihara . | |
| 4,910,802 | 3/1990 | Malloy | 2/69 |
| 4,953,856 | 9/1990 | Fox . | |
| 4,961,573 | 10/1990 | Wehrell . | |
| 4,968,028 | 11/1990 | Wehrell . | |
| 4,993,705 | 2/1991 | Tolle . | |
| 5,033,123 | 7/1991 | Audet . | |
| 5,046,194 | 9/1991 | Alaniz et al. | 2/69 |
| 5,060,315 | 10/1991 | Ewing . | |
| 5,062,642 | 11/1991 | Berry . | |
| 5,109,546 | 5/1992 | Dicker | 2/69 |
| 5,141,223 | 8/1992 | Block . | |
| 5,176,600 | 1/1993 | Wilkinson | 482/124 |
| 5,186,701 | 2/1993 | Wilkinson . | |
| 5,201,074 | 4/1993 | Dicker | 2/228 X |
| 5,203,754 | 4/1993 | MacLean . | |
| 5,256,119 | 10/1993 | Tudor . | |
| 5,263,916 | 11/1993 | Bobich . | |
| 5,267,928 | 12/1993 | Barile et al. | 482/124 |
| 5,282,277 | 2/1994 | Onozawa . | |
| 5,306,222 | 4/1994 | Wilkinson | 482/124 |
| 5,308,305 | 5/1994 | Romney | 482/124 |
| 5,336,139 | 8/1994 | Miller . | |
| 5,357,637 | 10/1994 | Moore | 2/227 |
| 5,367,708 | 11/1994 | Fujimoto . | |
| 5,372,565 | 12/1994 | Burdenko . | |
| 5,375,610 | 12/1994 | Lacourse . | |
| 5,383,235 | 1/1995 | Peters . | |
| 5,465,428 | 11/1995 | Earl . | |
| 5,518,481 | 5/1996 | Darkwah . | |
| 5,570,472 | 11/1996 | Dicker | 2/69 |

*Primary Examiner*—Gloria Hale
*Attorney, Agent, or Firm*—Connolly & Hutz

[57] ABSTRACT

An aerobic resistance garment for indoor use or warm weather use, includes a shorts section which has elongated resistance elements and which includes shoulder anchoring structure extending upwardly from the waist area of the shorts section for fitting over the user's shoulders. The legs of the shorts terminate above the calves of the user.

14 Claims, 3 Drawing Sheets

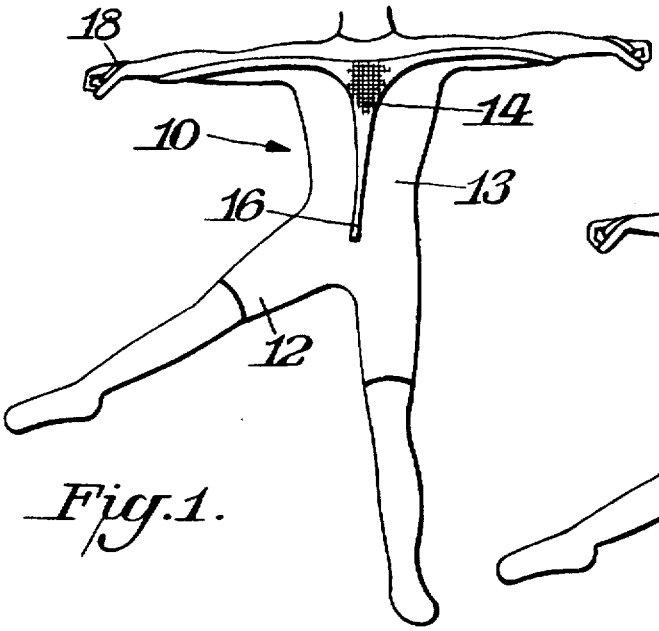
Fig.1.
Fig.2
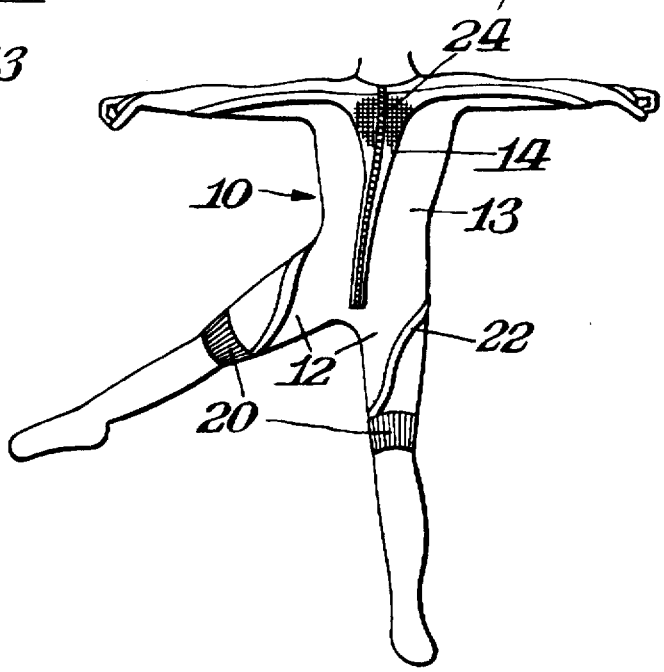
Fig.3.
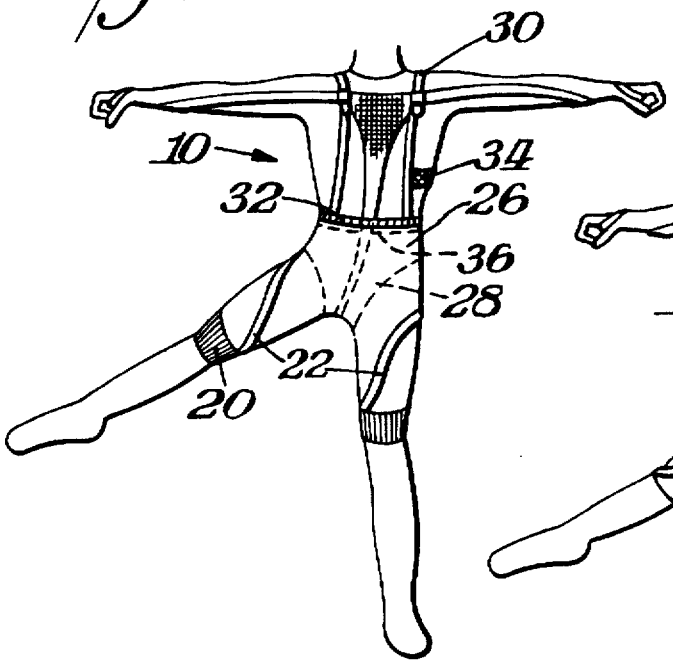
Fig.4.
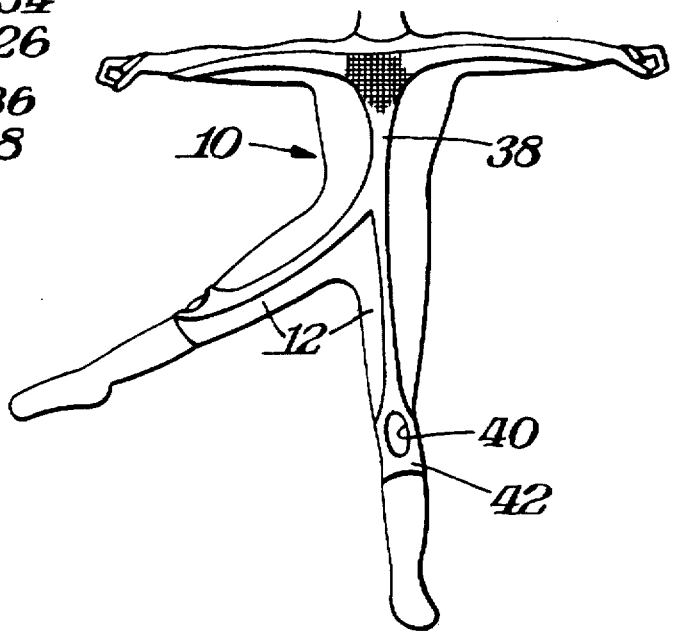

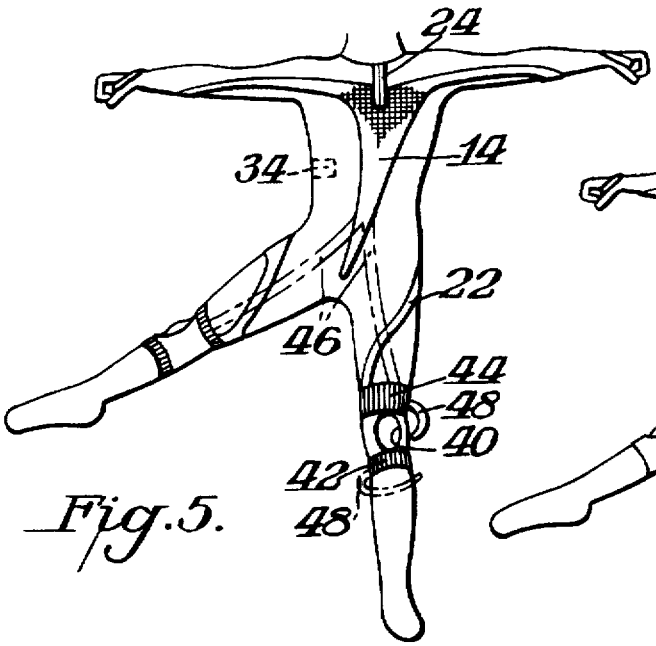
Fig.5.
Fig.7.
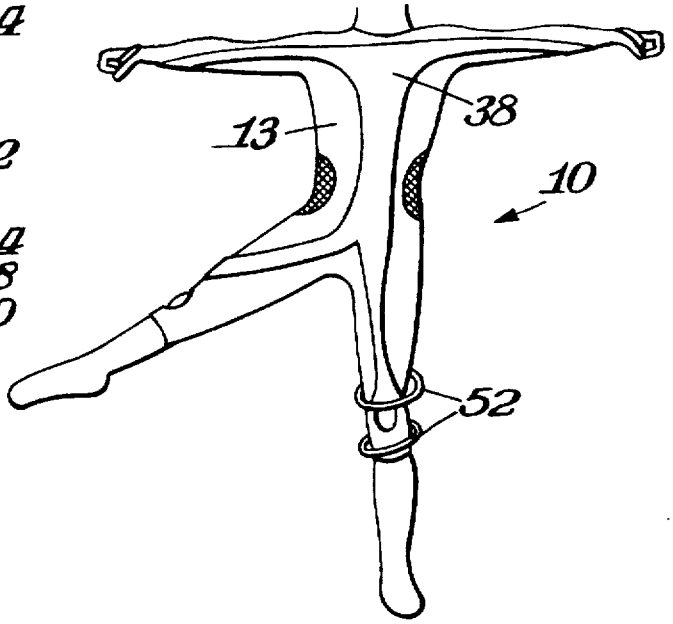
Fig.8.
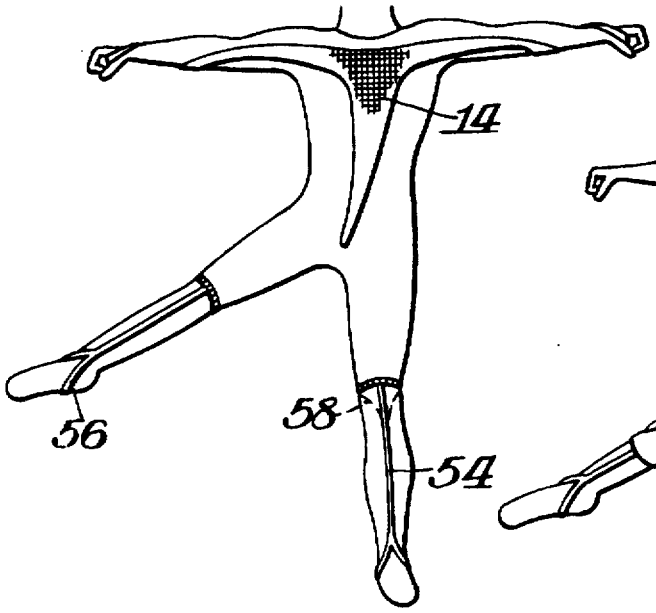
Fig.9.
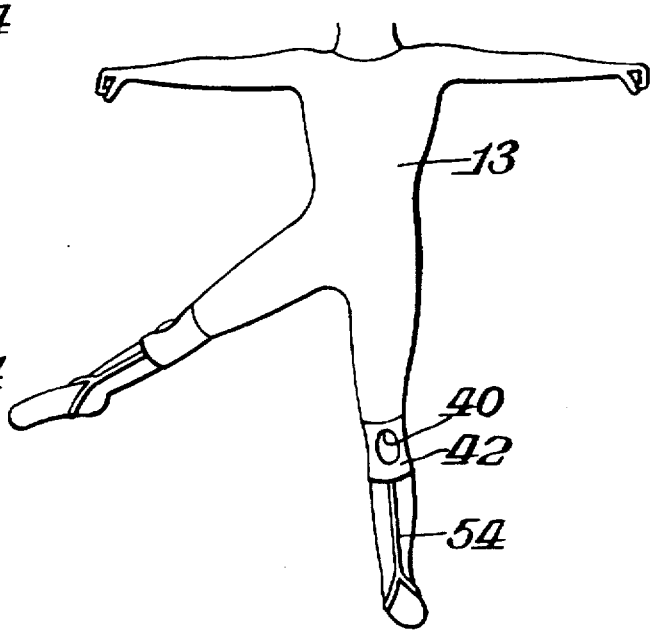

ENERGY EXPENDITURE GARMENT

BACKGROUND OF THE INVENTION

Various garments have been suggested which include elastic elements to provide a resistance to an activity which would require the swinging or bending of the arms or legs or the bending of various portions of the body. Examples of such garments are found in U.S. Pat. Nos. 5,109,546; 5,176,600; 5,186,701; 5,201,074; 5,306,222; and 5,570,472.

Such garments are generally used to supplement a main exercise so that when the exercise, such as some form of aerobic exercise, is being done it is also necessary for the wearer of the garment to expend additional energy to overcome the resistance from the elongated resistance elements. This extra expenditure of energy thus supplements the energy expended in the course of performing the main exercise.

SUMMARY OF THE INVENTION

An object of this invention is to provide an exercise garment which is particularly adaptable for indoor or warm weather use.

A further object of this invention is to provide such a garment which can effectively supplement a main exercise.

In accordance with this invention the garment is structured to be used in heated conditions such as indoors in heated gyms or outdoors in warm weather. This is particularly accomplished by forming the garment with a shorts section having a pair of legs which terminate above the calves of the user. The garment preferably also has some structure for anchoring the shoulders.

The shoulder anchoring structure can be suspenders or can be the formation of the garment with a tank or wrestler's top. The garment could be a one piece garment or could be two pieces with the top forming a separate piece.

THE DRAWINGS

FIGS. 1–10 are front elevational views showing various forms of garments in accordance with this invention.

DETAILED DESCRIPTION

Figure 6:
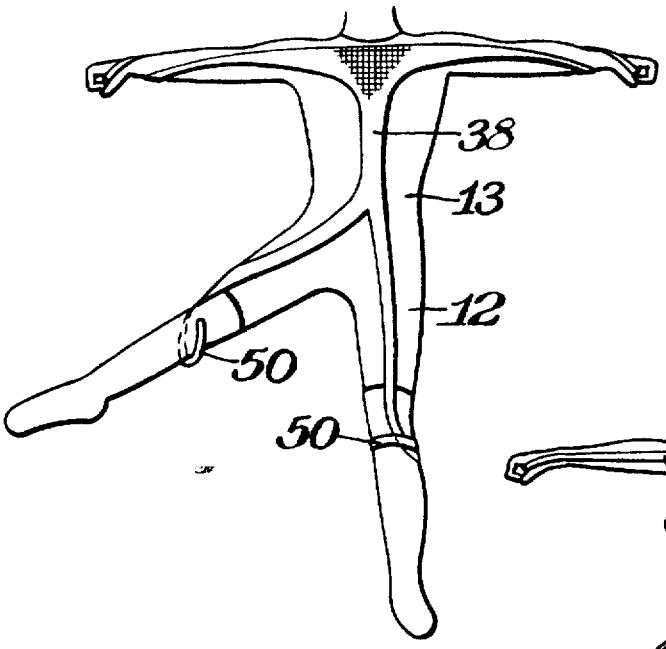

A great deal of exercise takes place indoors in heated gyms or in warmer weather. The present invention is primarily directed to a one piece resistance body suit featuring a tank or wrestler's top or suspenders with shorts. The invention could be practiced with more than one piece, such as two pieces featuring a plain top, leotard top or tank top wherein the shorts and top are preferably but need not be joined together. The main purpose of the garment is to be worn indoors or in warm weather and to provide resistance structures for increased aerobic exercise, muscular strengthening, development, toning, shaping and weight loss.

The bottom of the shorts may have some anchoring structure at various suitable locations, such as the thigh, knee, leg, ankle or foot. The anchoring means could be padded for extra comfort. The shorts or bottom could omit anchoring structure within the broad practices of this invention, but this is not as desirable a practice.

The shorts would have leg portions which terminate at various locations above the calf. In one form the leg portions would terminate above the knee with or without an elastic compression band located at about the bottom of the thigh.

In another form of the invention the leg portions would terminate over or below the knee with or without elastic compression bands under and/or above the knee. There could also be a cut-out for the knee cap. In addition, one or more straps or bands could be used alone as a substitute anchoring means or in addition to the elastic compression band to secure or wrap the bottom of the garment. The invention may also be practiced using any of the above noted anchoring structures in conjunction with one or more strips or bands that run to the bottom of the shorts or from the top down to the ankle/foot forming a loop or stirrup or could be attached by other means. The strip/bands running down to the foot could be used by themselves and not in conjunction with other anchoring means.

FIG. 1 illustrates a garment 10 in accordance with one practice of the invention. As shown therein, the garment 10 is a one piece suit wherein the legs 12 terminate in the mid thigh area. As shown in FIG. 1 the elongated resistance element or band 14 is generally tee shaped in the body portion—with the resistance band gradually tapering and fading out slightly below the navel as indicated by the reference numeral 16. The resistance band would also extend laterally down the arms and could be spirally wrapped so as to terminate in a hand loop 18 for anchoring the resistance band. Preferably, the rear side of the garment would be of identical structure as the front side.

The garment could be made of any suitable materials and the resistance elements may take various forms, such as described in U.S. Pat. Nos. 5,109,546; 5,176,600; 5,186,701; 5,201,074; 5,306,222; and 5,570,472, all of the details of which are incorporated herein by reference thereto. It is to be understood that such details may equally be utilized where appropriate with the other embodiments described herein.

If desired, the garment 10 could be made of an elastic type material such as SPANDEX® or LYCRA®, but wherein the resistance band 14 would apply a greater resistance force. The resistance band 14 could be secured to (inside or outside) the garment or could be an integral section of the garment. Preferably the resistance band is a panel in the garment offering greater resistance force than adjacent parts of the garment.

FIG. 2 illustrates a further resistance garment 10 in accordance with a further practice of this invention. As shown therein the garment is a one piece shorts with a body suit or tank top similar to the suit shown in FIG. 1. FIG. 2, however, illustrates variations wherein the bottom of the legs 12 terminates in compression bands 20. Compression bands 20 are made of elastic material to anchor resistance elements 22 which are provided on the garment 10 in addition to the resistance band 14. As shown in FIG. 2, the garment 10 is also provided with an optional zipper 24 to facilitate the putting on and/or removal of the garment. As with the garment of FIG. 1 the garment of FIG. 2 also terminates above the knee.

FIG. 3 illustrates a further garment 10 which has a shorts sections 26 worn over a leotard 28. The elastic band is part of the leotard top while the elastic bands 22 are part of the shorts. If desired, the shorts are provided with suspenders 30 or shoulder loops for anchoring the shorts on the body. The suspenders 30 may be made adjustable by the provision of buckles as illustrated. The shorts 26 also include an elastic waist band 32. If desired, the top may be made of a mesh material as indicated by the reference numeral 34 for added comfort. The top is preferably fastened to the shorts either permanently or detachably by any suitable structure indicated by the reference numeral 36.

FIG. 4 illustrates a garment 10 which is of one piece construction. Unlike the prior garments in FIGS. 1–3, garment 10 terminates below the knees with the resistance band 38 extending generally the length of the garment including the arms and the legs. As shown in FIG. 4 an open patella ring 40 is provided in the leg area and specifically in the resistance band. The resistance band also terminates in a compression band 42.

FIG. 5 illustrates a garment in the form of a one piece suit having a shorts section with a body portion or tank top and having resistance bands 14 and 22 similar to those in FIG. 2. In FIG. 5, however, a compression band 44 is provided above the knee in addition to the compression band 42 below the knee. The knee area itself is not provided with resistance bands unlike the embodiment of FIG. 4. A patella cut-out 40, however, is provided. FIG. 5 shows in phantom an optional resistance band pattern 46. FIG. 5 also illustrates optional bands or loops 48 to create additional tension rings wherein the loops are provided with any suitable fastening elements such as VELCRO® (hook and loop fastener) to close the loops. The embodiment illustrated in FIG. 5 could also be made in two pieces such as by providing the shorts with loops and a leotard top or to some top which fastens to the top of the shorts similar to that of FIG. 3. As in FIG. 3 suspenders could also be utilized for mounting the shorts.

FIG. 6 illustrates a garment wherein the resistance bands 38 extends beyond the leg portions 12 as indicated by the extension 50 so that the extension 50 would be below the knees and loop around the leg above the calf to form a resistance ring. The extension 50 may be secured to itself in any suitable manner by fasteners such as VELCRO® (hook and loop fastener) to form a ring to function as an anchor structure. The advantage of this arrangement is to provide adjustable tension. Thus, as shown although the legs 12 terminate mid-thigh, the anchoring of the resistance band 38 is achieved below the knee.

FIG. 7 illustrates a garment 10 which is similar to the garment shown in FIG. 4, but differs in that bands or loops 52 may be provided at one or both legs to create additional tension rings. The bands are formed into loops by being secured to itself through the use of any suitable fasteners and may be located above and/or below the knee.

FIG. 8 illustrates a garment which also includes a resistance band 14 similar to FIG. 2. In FIG. 8 the compression band at the lower end of each leg is located above the knee and is provided with strips or bands 54 which form foot stirrups 56. FIG. 8 shows in phantom by the reference numeral 58 an optional resistance element pattern. As with the various other garments, the garment shown in FIG. 8 could be a one or two piece suit. The strips or bands 54 could comprise a single band on each leg or could be multiple bands on the front and/or back and/or side of each leg.

FIG. 9 shows a variation of the garment shown in FIG. 8 wherein the added band 54 is secured to an enlarged compression band 42 having a patella opening 40.

Figure 10:
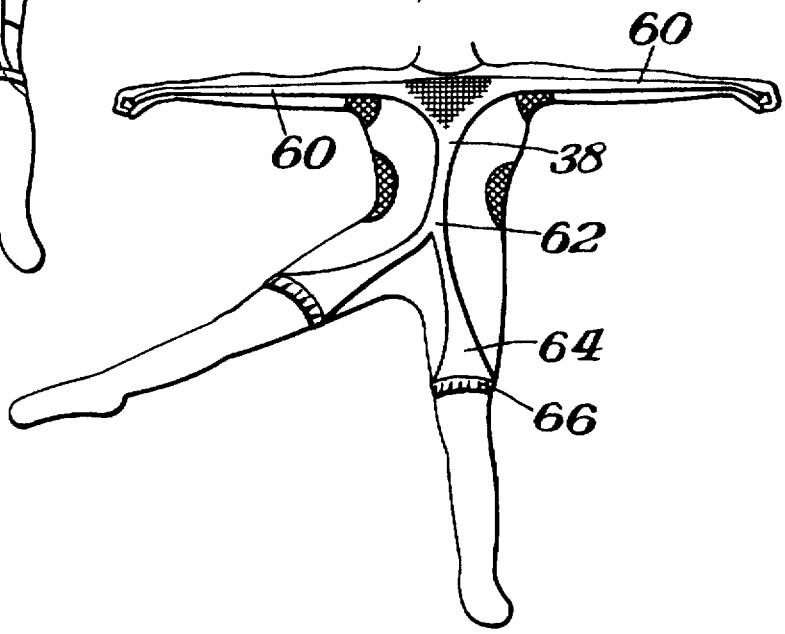

FIG. 10 illustrates a garment which may include the resistance band 38 which includes a pectoral/arm resistance panel 60 and an abdominal spinal resistance panel 62 as well as a quads or hamstring resistance band 64. The leg terminates in a portion which joins the hamstring panels to form a tension ring 66. This arrangement will increase the resistance because of the added abdominal/rector and quad/hamstring short panels.

It is to be understood that various features shown in particular embodiments may be used in other embodiments within the practice of this invention.

What is claimed is:

1. An aerobic resistance garment for indoor use or warm weather use comprising a shorts section, said shorts section having a waist area and a pair of legs with an intermediate body area below said waist area and above said legs, elongated resistance elements in said shorts section, a shoulder anchoring structure mounted to and extending upwardly from said waist area for fitting over the wearer's shoulders, said legs terminating above the calves of the user, said garment including a shirt section with arms and a body portion, said body portion having a navel portion and a torso said elongated resistance elements comprising a T-shaped resistance band which extends across said body portion and said arms of the garment and downwardly on said torso of the garment, and said band tapering to a termination point below said navel portion.

2. An aerobic resistance garment for indoor use or warm weather use comprising a shorts section, said shorts section having a waist area and a pair of legs with an intermediate body area below said waist area and above said legs, elongated resistance elements in said shorts section, a shoulder anchoring structure mounted to and extending upwardly from said waist area for fitting over the wearer's shoulders, said legs terminating above the calves of the user, a leotard worn above and extending below said shorts section, said shorts section being separate from and fastened to said leotard, said elastic resistance elements including a T-shaped resistance band in said leotard, said leotard having arm portions, said T-shaped resistance band extending in said arm portions of said leotard and extending downwardly to said shorts section, further resistance bands on said shorts section, each of said legs having a lower end and a compression band at said lower end, and said further resistance bands being anchored to said compression bands.

3. The garment of claim 2 including suspenders secured to said shorts section.

4. An aerobic resistance garment for indoor use or warm weather use comprising a shorts section, said shorts section having a waist area and a pair of legs with an intermediate body area below said waist area and above said legs, elongated resistance elements in said shorts section, a shoulder anchoring structure mounted to and extending upwardly from said waist area for fitting over the wearer's shoulders, said legs terminating above the calves of the user, said legs terminating below the knee, and an open patella ring formed in said legs.

5. The garment of claim 4 wherein each of said legs terminating in a lower end, said elongated resistance elements including a resistance band which extends along said legs to the ends of said legs, and said open patella ring being formed in said resistance bands.

6. The garment of claim 5 wherein said garment includes a shirt section integral with said shorts section to form a one piece garment, said shirt section having a pair of arms, and said elongated resistance elements further including a resistance band extending from arm to arm and having a section which extends downwardly to said legs.

7. An aerobic resistance garment for indoor use or warm weather use comprising a shorts section, said shorts section having a waist area and a pair of legs with an intermediate body area below said waist area and above said legs, elongated resistance elements in said shorts section, a shoulder anchoring structure mounted to and extending upwardly from said waist area for fitting over the wearer's shoulders, said legs terminating above the calves of the user, said elongated elements includes resistance bands extending below said legs and each of said resistance bands being secured to itself to terminate in a loop which forms a tension ring below each leg.

8. The garment of claim 7 wherein said legs terminate in a mid-thigh section, said garment including a shirt section integral to said shorts section, said shirt section having a pair of arms, said elongated resistance elements comprising an integral resistance band extending from arm to arm of said shirt section and extending downwardly to said shorts section and then bifurcating into a pair of segments, each of said band segments extending down one of said legs.

9. An aerobic resistance garment for indoor use or warm weather use comprising a shorts section, said shorts section having a waist area and a pair of legs with an intermediate body area below said waist area and above said legs, elongated resistance elements in said shorts section, a shoulder anchoring structure mounted to and extending upwardly from said waist area for fitting over the wearer's shoulders, said legs terminating above the calves of the user, including a shirt section integral with said shorts section, said shirt section having a pair of arms, said elongated resistance elements comprising a resistance band extending from arm to arm and extending downwardly from said shirt section to said shorts section, said resistance elements further including said resistance bands extending down said legs, each of said legs terminating in an end, at least one compression band at said end of each of said legs, and said resistance bands extending down said legs being mounted to said at least one compression band.

10. The garment of claim 9 wherein said at least one compression band comprises a compression band said end of each of said legs, said compression bands being mounted on the garment above and below the knee, and said garment further includes an open patella ring.

11. An aerobic resistance garment for indoor use or warm weather use comprising a shorts section, said shorts section having a waist area and a pair of legs with an intermediate body area below said waist area and above said legs, elongated resistance elements in said shorts section, a shoulder anchoring structure mounted to and extending upwardly from said waist area for fitting over the wearer's shoulders, said legs terminating above the calves of the user, a shirt section being integrally connected to said shorts section, said shirt section having a pair of arms, said elongated resistance elements comprising a resistance band extending from arm to arm and extending downwardly of said shirt section to said shorts section, said resistance elements further extending down said legs, each of said legs terminating in an end and adjustable tension rings mounted at said end of said legs.

12. An aerobic resistance garment for indoor use or warm weather use comprising a shorts section, said shorts section having a waist area and a pair of legs with an intermediate body area below said waist area and above said legs, elongated resistance elements in said shorts section, a shoulder anchoring structure mounted to and extending upwardly from said waist area for fitting over the wearer's shoulders, said legs terminating above the calves of the user, including a shirt section integral with said shorts section, said shirt section having a pair of arms, said elongated resistance elements comprising a resistance band extending from arm to arm and extending downwardly of said shirt section to said short section, each of said legs terminating in an end, a further resistance band being mounted to said end of each of said legs and extending down said legs for being anchored to the foot of the user.

13. The garment of claim 12 wherein said further resistance bands terminate in a foot stirrup which is mounted to the leg of the user.

14. An aerobic resistance garment for indoor use or warm weather use comprising a shorts section, said shorts section having a waist area and a pair of legs with an intermediate body area below said waist area and above said legs, elongated resistance elements in said shorts section, a shoulder anchoring structure mounted to and extending upwardly from said waist area for fitting over the wearer's shoulders, said legs terminating above the calves of the user, said garment including a shirt section integral with said shorts section, said shirt section having a pair of arms, said elongated resistance elements comprising a resistance band extending from arm to arm to form pectoral/arm resistance panels, said resistance band further including an abdominal rector, spinal resistance panel and further including a quad/hamstring resistance band and terminating in a tension ring joined to said quad/hamstring resistance band.

* * * * *